US010723524B2

(12) United States Patent
Schoen et al.

(10) Patent No.: US 10,723,524 B2
(45) Date of Patent: Jul. 28, 2020

(54) TAMPER-EVIDENT LOCK FOR THERMOFORMED CONTAINER

(71) Applicant: DOUGLAS STEPHEN PLASTICS, INC., Paterson, NJ (US)

(72) Inventors: Curt Schoen, Lake Hiawatha, NJ (US); Douglas B. Graff, Woodcliff Lake, NJ (US)

(73) Assignee: EasyPak DSP, LLC, New York, NY (US)

( * ) Notice: Subject to any disclaimer, the term of this patent is extended or adjusted under 35 U.S.C. 154(b) by 81 days.

(21) Appl. No.: 15/814,106

(22) Filed: Nov. 15, 2017

(65) Prior Publication Data

US 2019/0144171 A1 May 16, 2019

(51) Int. Cl.
*B65D 43/02* (2006.01)
*B65D 43/16* (2006.01)

(52) U.S. Cl.
CPC ..... *B65D 43/0254* (2013.01); *B65D 43/162* (2013.01); *B65D 2401/10* (2020.05); *B65D 2401/15* (2020.05); *B65D 2543/0062* (2013.01); *B65D 2543/00092* (2013.01); *B65D 2543/00731* (2013.01); *B65D 2543/00833* (2013.01)

(58) Field of Classification Search
CPC ..... B65D 43/00–162; B65D 2101/00–2101/0023; B65D 2543/00–00731; B65D 2543/00833; B65D 2101/003; B65D 2101/0038; B65D 2101/0046; B65D 2101/0069; B65D 2101/0076
USPC ..... 220/260, 265, 266, 270, 359.2, 640; 206/807
See application file for complete search history.

(56) References Cited

U.S. PATENT DOCUMENTS 2,915,214 A * 12/1959 Frankel ..... B65D 75/22 220/266
7,118,003 B2 10/2006 Sellari et al.
7,597,206 B2 10/2009 Atkins et al.
8,240,505 B1 * 8/2012 Chen ..... B65D 43/162 220/4.21
8,251,249 B1 * 8/2012 Vovan ..... B65D 43/021 206/228
8,272,526 B1 * 9/2012 Vovan ..... B65D 43/0254 220/270
8,608,008 B2 * 12/2013 Gingras ..... B65D 43/0254 220/270
9,981,782 B2 * 5/2018 Kalmanides ..... B65D 43/0239
(Continued)

*Primary Examiner* — Kareen K Thomas
(74) *Attorney, Agent, or Firm* — Abelman, Frayne & Schwab

(57) ABSTRACT

A one-piece thermoformed reclosable plastic container includes a base defining a chamber, a cover for closing the base, an integral hinge connecting the base and cover for relative movement, and a tamper-evident locking assembly formed by opposing members extending outwardly from the periphery of the base and cover that are configured to securely engage with each other in an initial closed and locked position of the container. At least one of the two locking members includes an engaged portion that is releasably connected to a periphery of the base and/or the cover and is manually removed when the container is initially opened, making it apparent to the merchant and/or customer that the locking assembly has been opened.

29 Claims, 6 Drawing Sheets

(56) References Cited

U.S. PATENT DOCUMENTS

| | | | | |
|---|---|---|---|---|
| 2005/0133508 | A1* | 6/2005 | Landis | B65D 43/027<br>220/276 |
| 2005/0184070 | A1* | 8/2005 | Boback | B65D 43/021<br>220/266 |
| 2006/0289549 | A1* | 12/2006 | Vovan | B65D 43/021<br>220/791 |
| 2017/0283139 | A1* | 10/2017 | Fosse | B65D 55/024 |

* cited by examiner

TAMPER-EVIDENT LOCK FOR THERMOFORMED CONTAINER

BACKGROUND OF THE INVENTION

1. Field of the Invention

The present invention relates to a tamper-evident lock for use with a one-piece thermoformed container having a one-step closure.

2. Description of the Prior Art

Lightweight resealable plastic containers, commonly referred to as clam-shell containers, are commonly used in the retail sale of fresh salads and a variety of other food products, and also for storing food items, such as dried fruits, nuts, spices and the like. To avoid problems resulting from tampering with the contents, a reclosable container can be provided with tamper-evident locking features which include structural elements that provide the merchant and customers with a readily apparent means for indicating whether any tampering with the closure of the container has occurred.

For example, U.S. Pat. No. 7,118,003 discloses a transparent, reclosable, plastic clamshell container provided with a tamper-evident feature. The container has a base that defines a storage area and a cover for closing the storage area. The cover has an outwardly extending peripheral flange, and the base has an upper peripheral edge that forms an upwardly projecting bead extending about the perimeter of the base for receiving the peripheral flange of the cover portion. The bead is configured to render the outwardly extending peripheral flange of the cover relatively inaccessible when the container is closed. The base is provided, beneath the peripheral edge, with a circumferential rib which is received in a circumferential groove formed in the cover beneath the peripheral flange in a closed position of the container. The bead hinders the relatively easy separation of the cover and base portion, impeding access to the cover's peripheral flange edge from fingers or any other object that can be used to pry the cover from the base portion. The base and cover have, respectively, projecting tabs substantially parallel to each other and spaced apart when the cover is in position on the base and their projecting ends are connected by a "pull strip" which initially serves as a hinge, but is also the tamper-evident element. The strip, upon being pulled off, severs the integral connection between the cover and base portion. The absence of the strip indicates tampering with the container.

A drawback of the solution proposed in U.S. Pat. No. 7,118,003 is the complicated structure of the lock arrangement. With the base bead extending over the cover flange, repeated closing and opening of the container is made more difficult. Further, the removal of the indicia strip requires an additional effort by a consumer in opening the container. Another drawback of the container disclosed in U.S. Pat. No. 7,118,003 is that it is formed of two separate components which complicate its closing after it has been opened.

A reclosable, transparent plastic clamshell container with a simplified one-step closure is disclosed in U.S. Pat. No. 7,597,206. The container has a base portion for receiving food items and a cover joined by an integral hinge that provides for access and closing of the container. The base, cover and hinge are formed from a single sheet of plastic in a thermoforming step.

The problem addressed by the present invention is to provide an improved thermoformed polymeric container with an easily removable tamper-evident locking closure, the absence of which is readily apparent to merchants and purchasers.

SUMMARY OF THE INVENTION

The above problem is addressed and other advantages are achieved by providing a one-piece reclosable thermoformed polymer container having a base for receiving a product, e.g., a consumable product, a cover for closing the base and an integral hinge portion dimensioned and configured to provide for relative movement between the base and the cover for access and closing the container, and a tamper-evident interface formed by two members which form parts of the base and the cover, respectively, extend outwardly from respective periphery of the base and the cover and which securely engage each other in the closed and locked position of the container, with one of the two members being releasably connected to the base or the cover and being separated therefrom upon initial access of the container. The separation of the respective member from the base or the cover indicates that an attempt to open the container has been made.

Generally, the two members are formed as tabs, with one of the tabs having a projecting male element and the other tab having a recess for receiving the projecting male element in a snap-fit interlocking relation. With the projecting male element of one tab being interlocked in the recess of the other tab, a snap-fit lock for fixedly securing the cover to the base in the initial closed position of the container is formed. When the container is initially opened, the tamper-evident member is torn away from the cover or base portion. The tamper-evident member, upon being torn away, removes the locking connection of the cover and base portions, so that the cover can be opened. The snap-fit lock is preferably located opposite the hinge center.

The locking members will be described in relation to a typical one-piece clam shell container. In an embodiment, the upper periphery of the base portion of the container terminates in an outwardly extending circumferential flange, below which is formed an outwardly projecting recess in the wall of the base proximate the circumferential flange and extending around the periphery of the base. The cover also terminates in an outwardly extending circumferential flange that is complementary to the circumferential flange of the base portion. An outwardly projecting ridge is formed in a depending rim that forms part of the cover below the circumferential flange, the projecting ridge being configured and dimensioned to sealingly engage the recess formed in the wall of the base in the closed position. As will be understood by one of ordinary skill in the art, the shape of the container and the particular means by which the cover is sealed joined to the base forms no part of the present invention, since the locking assembly is adaptable for use with a wide variety of such containers.

The pair of tamper-evident locking members for releasably securing the thermoformed cover and base portions of the container together in fluid-tight sealed relation extend from the periphery of the base and cover flanges, respectively, and are dimensioned and configured to closely engage in superposed relation when contents have been placed in the base and the cover is secured to the base. The locking members include:

(a) a male locking member having at least one integrally molded male element projecting upwardly from the surface, and (b) a female locking member having at least one integrally molded enclosed recess projecting downwardly from the surface. The recess, or recesses, are being configured and dimensioned to receive and engage the corresponding projecting male element(s) in a secure, manually releasable snap-fit arrangement when the cover and base are in their sealed position in preparation for display and sale. The male locking member or the female locking member includes integrally formed laterally extending pull tabs on either side of the engaged portion of the locking member, and the pull tabs and intermediate engaged p on are joined to the periphery of the container along a line of manually separable perforations, so that when the locking members are separated by manually tearing and removing the pull tabs and intermediate engaged locking section along the line of perforations, the container can be opened. In a preferred embodiment, the line of perforations is spaced apart from the periphery of the container to provide a laterally projecting gripping tab dimensioned and configured with projecting elements and/or a textured surface to assist in manually separating the cover from the base.

In the initial closed and locked position of the container, the flanges of the cover and the base securely engage each other preventing any attempt to manually open the container, (e.g., by an individual using his/her fingers), until the releasably connected locking tab is torn away.

The tamper-evident interface according to the present invention provides a readily apparent means for the merchant and/or customers to identify any tampering with the container, while insuring an easy opening of the container by the user.

The novel features of the present invention, which are considered as characteristic of the invention, are set forth in the appended claims. The invention itself, however, both as to its construction and its mode of operation, together with additional advantages and objects, will be best understood from the following detailed description of a preferred embodiment, when read with reference to the accompanying drawings.

BRIEF DESCRIPTION OF THE DRAWINGS

The invention will be further described below with reference to the drawings in.

To facilitate an understanding of the invention, identical numerals have been used, when appropriate, to designate the same or similar elements that are common to all of the figures. Further, unless stated otherwise, the features shown in the figures are not drawn to scale, but are shown for illustrative purposes only.

DETAILED DESCRIPTION OF THE PREFERRED EMBODIMENTS

A one-piece thermoformed reclosable plastic container illustratively disclosed herein includes a base defining a chamber, a cover for closing the base, an integral hinge connecting the base and cover for relative movement, and a tamper-evident locking assembly formed by opposing members extending outwardly from the periphery of the base and cover that are configured to securely engage with each other in an initial closed and locked position of the container. At least one of the two locking members includes an engaged portion that is releasably connected to a periphery of the base and/or the cover and is manually removed when the container is initially opened, making it apparent to the merchant and/or customer that the locking assembly has been opened. The improved tamper-evident lock of the invention will he described in the context of a one-piece thermoformed plastic clam shell container that is illustrated in the series of FIGS. 1-11.

Figure 1:
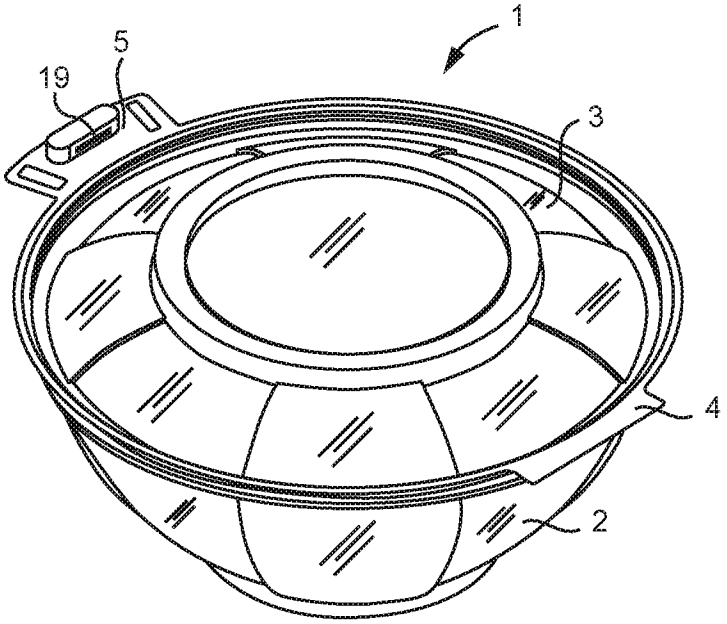
FIG. 1 is a top, rear, right-side perspective view of an embodiment of a one-piece reclosable plastic container having a base, cover, hinge and tamper evident locking members according to the present invention.
Figure 3:
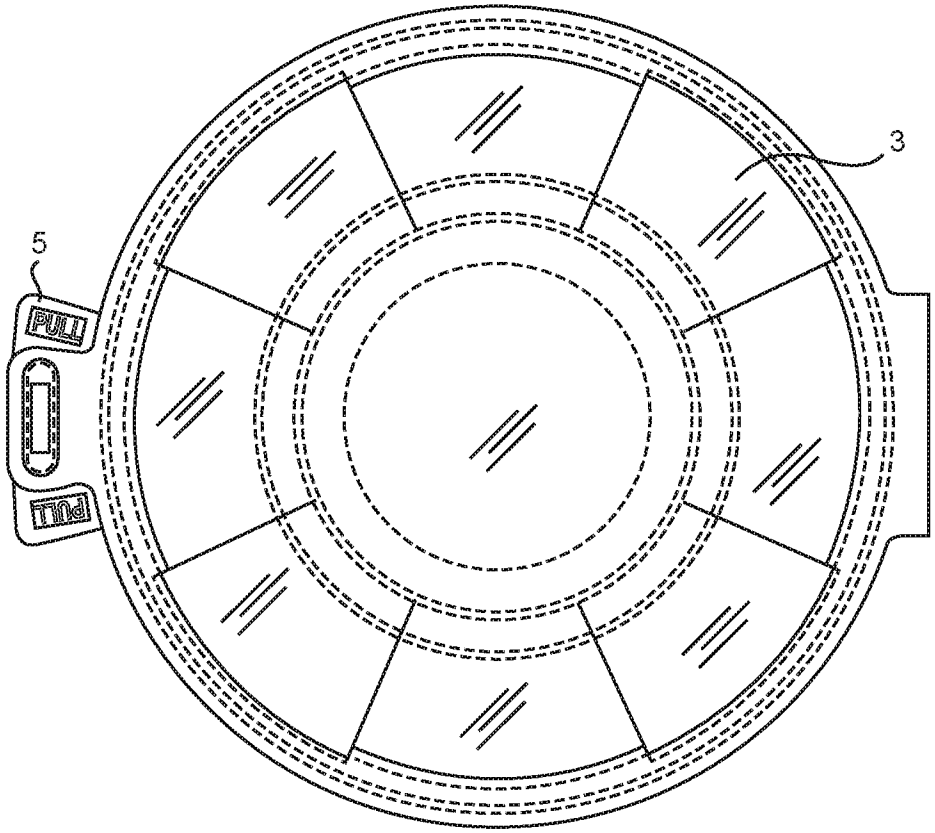
FIG. 3 is a top plan view of the container shown in FIG. 1.

Referring now to FIG. 1, a reclosable one-piece plastic container 1 is shown with a base 2 that defines a storage space, and a cover 3 joined to the base by an integrally formed hinge 4 that permits relative movement between the closed and open positions. The container 1 also includes an interlocking or snap-fit locking assembly 5 for securing the base 2 and the cover 3 together in their initial closed position. Preferably, the snap-fit locking assembly 5 is located opposite from the center of the hinge 4. As will be described below in further detail, the snap-fit locking assembly 5 is configured to indicate that the container has been opened after the locking members are initially engaged.

Figure 4:
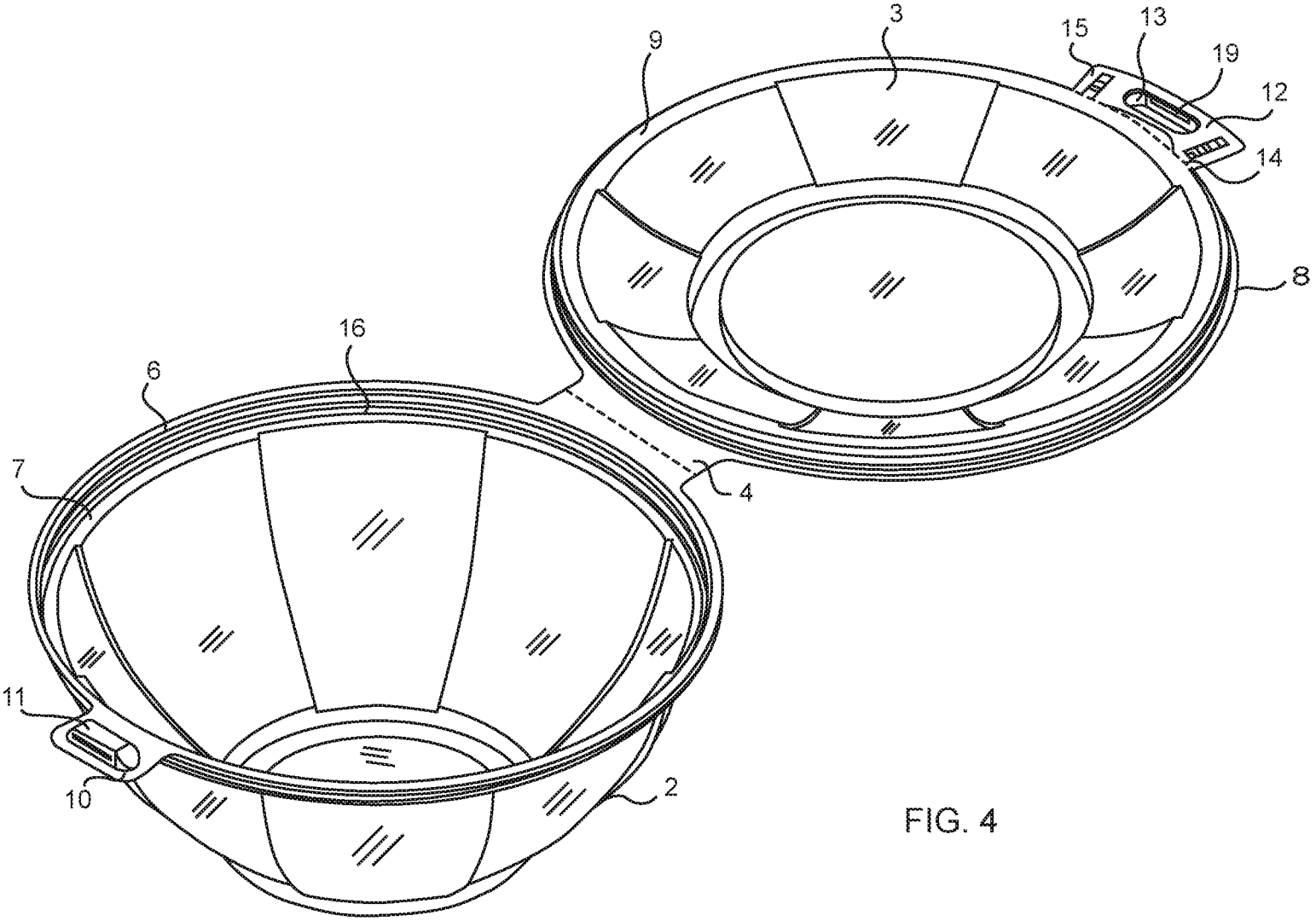
FIG. 4 is a top, front, right-side perspective view of the container shown in FIG. 1 in an open position thereof.
Figure 5:
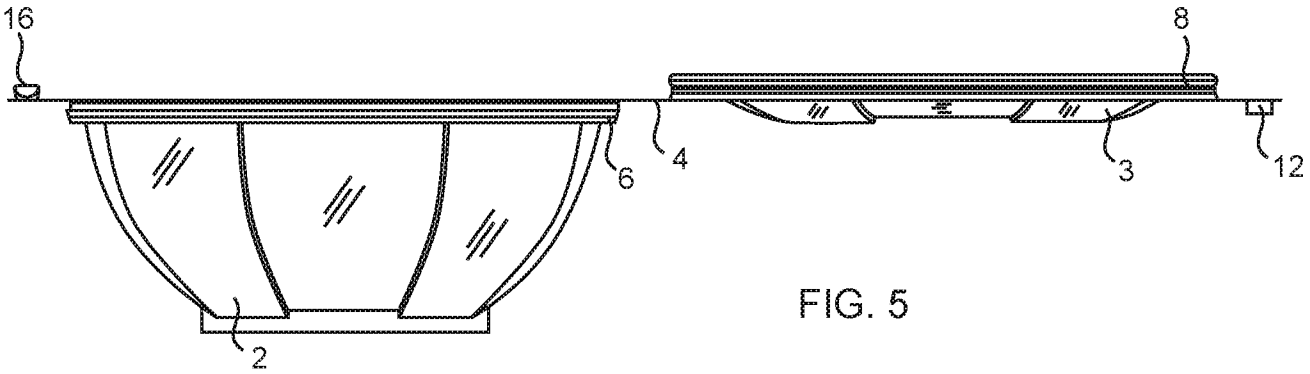
FIG. 5 is a right-side elevational view of the open container shown in FIG. 4.
Figure 6:
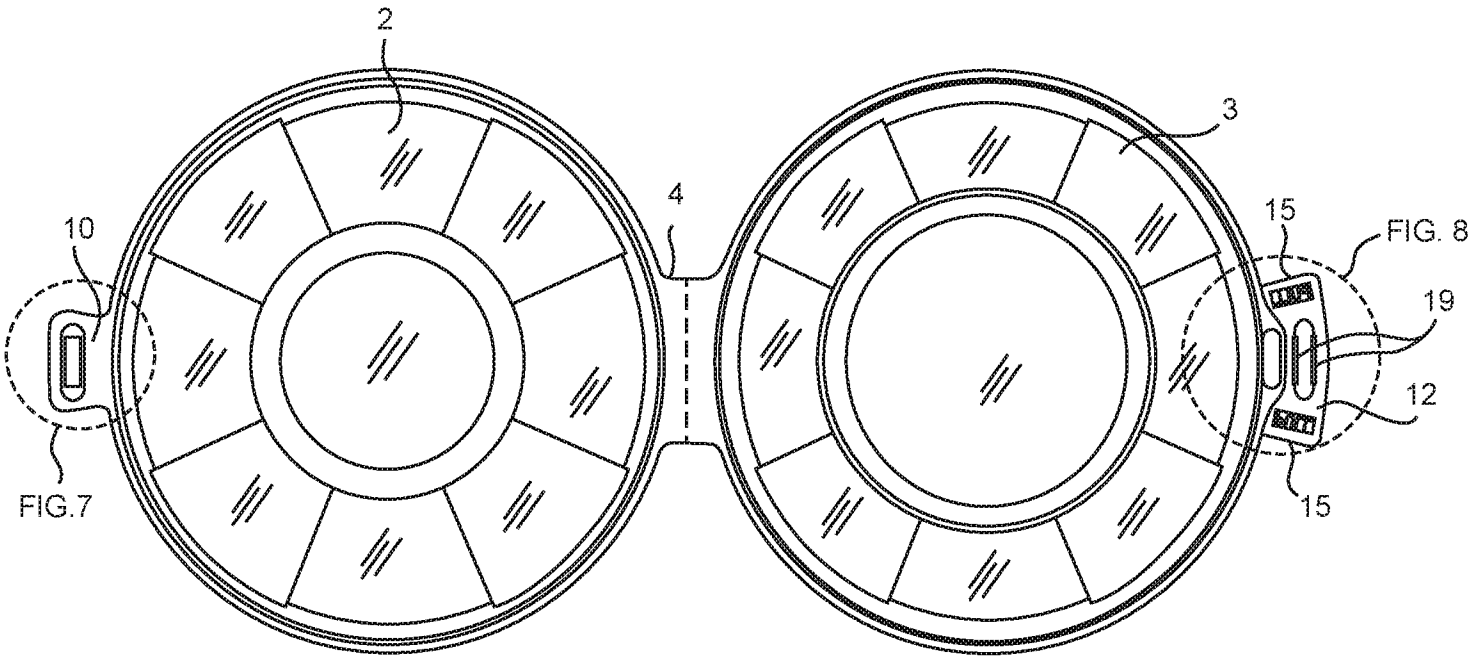
FIG. 6 is a top plan view of the open container shown in FIG. 4.
Figure 8:
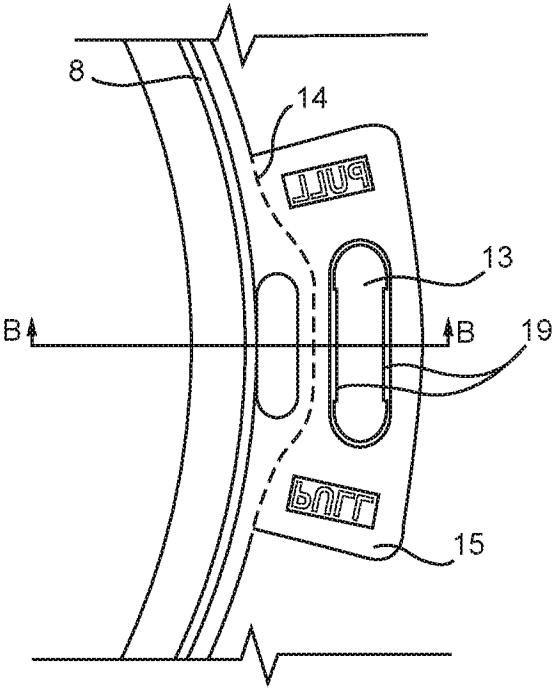
FIG. 8 is an exploded top plan view of a complimentary female tab of a snap-fit locking member for securing the reclosable plastic container taken from circled portion of FIG. 6.
Figure 10:
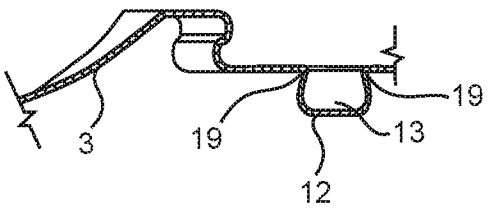
FIG. 10 is a cross-sectional view taken along a plane B-B in FIG. 8.
Figure 7:
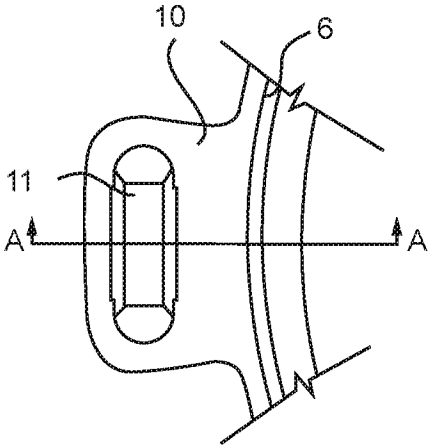
FIG. 7 is an exploded top plan view of a male tab of a snap-fit locking member for securing the reclosable plastic container taken from circled portion of FIG. 6.
Figure 9:
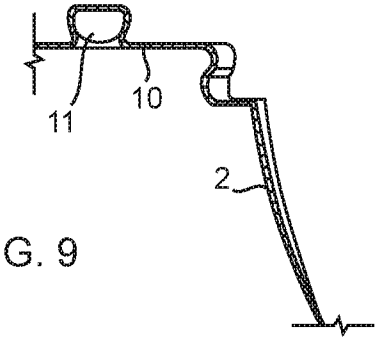
FIG. 9 is a cross-sectional view taken along a plane A-A in FIG. 7.
Figure 11:
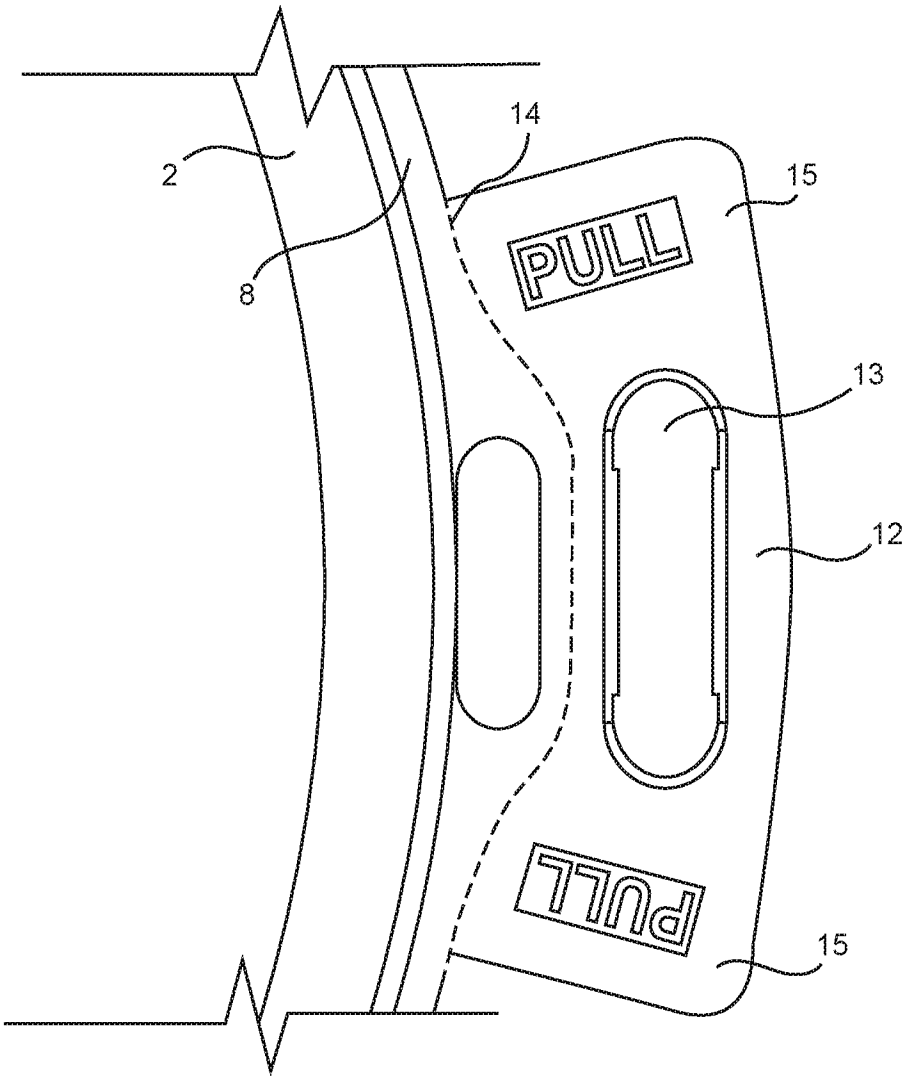
FIG. 11 is an enlarged partial top plan view showing a detail of the attachment of a pull-off tab to the cover of the container and separable along a line of perforations.

Referring to FIG. 4, the base 2 can include an outwardly extending circumferential flange 6 and a shoulder 7 provided immediately beneath the circumferential flange 6 and extending around the entire circumference of the base 2. The shoulder 7 includes an outwardly projecting recess 16 in the wall. The cover 3 includes a complimentary outwardly extending circumferential flange 8 and a ridge 9 located immediately below the circumferential flange 8 for sealingly engaging the recess 16 in the base 2 when the container is closed.

The integral base 2, cover 3, hinge 4 and locking assembly 5 can be thermoformed from suitable polymeric materials known in the art that are conventionally used for producing clam shell containers.

The snap-fit locking assembly 5 is formed by the engagement of opposing locking members which, in the initial closed position, engage and interlock with each other forming the tamper-evident lock. A first member 10 can be fixedly secured to the base 2 and have an upwardly extending male projecting element 11 which, in the embodiment is shown in the drawings, is rectangular, but the male element can have any geometrical shape, e.g., oval, circular or square. The first member 10 is formed as a tab attached to the edge of the circumferential flange 6 of the base 2. For example, the first member 10 can have, e.g., a shape of a square with rounded corners and with the projection 11 being formed by indenting the tab, as illustratively shown in the drawings, Preferably, the first member 10 is formed together with the base 2 during the molding process.

A second member 12, which is also formed as a tab, is integrally formed as an extension of to the edge of the circumferential flange 8 of the cover 3 along a weakened separation line 14. The second member 12 is provided with a recess 13 complementary to the male projecting element 11, which is received in the secure snap-fit relation. The second member 12 preferably extends laterally beyond the first member 10 in the closed position of the container. In the initial closed position of the container, the circumferential flanges 6 and 8 of the base 2 and cover 3 are likewise securely engaged. For example, preferably one or more pull-tabs 15 extend laterally from the male locking member 11 and/or the female locking member 13 to permit a user to separate the locking members 10 and 12 from each other and open the container 1. The projection 11 and recess 13 are formed by surface areas having a predetermined coefficient of friction such that, when projection is inserted into the recess for the first time, i.e., the snap-fit lock 5 is initially closed, the frictional forces between the projection 11 of the first member and the recess 13 of the second member are greater than the shearing force or other separation forces required to detach the second member 12 from the cover 3 along the weaken line 14. In an embodiment, the female locking member 13 can include one or more indentations 19 formed in its sidewall.

Figure 2:
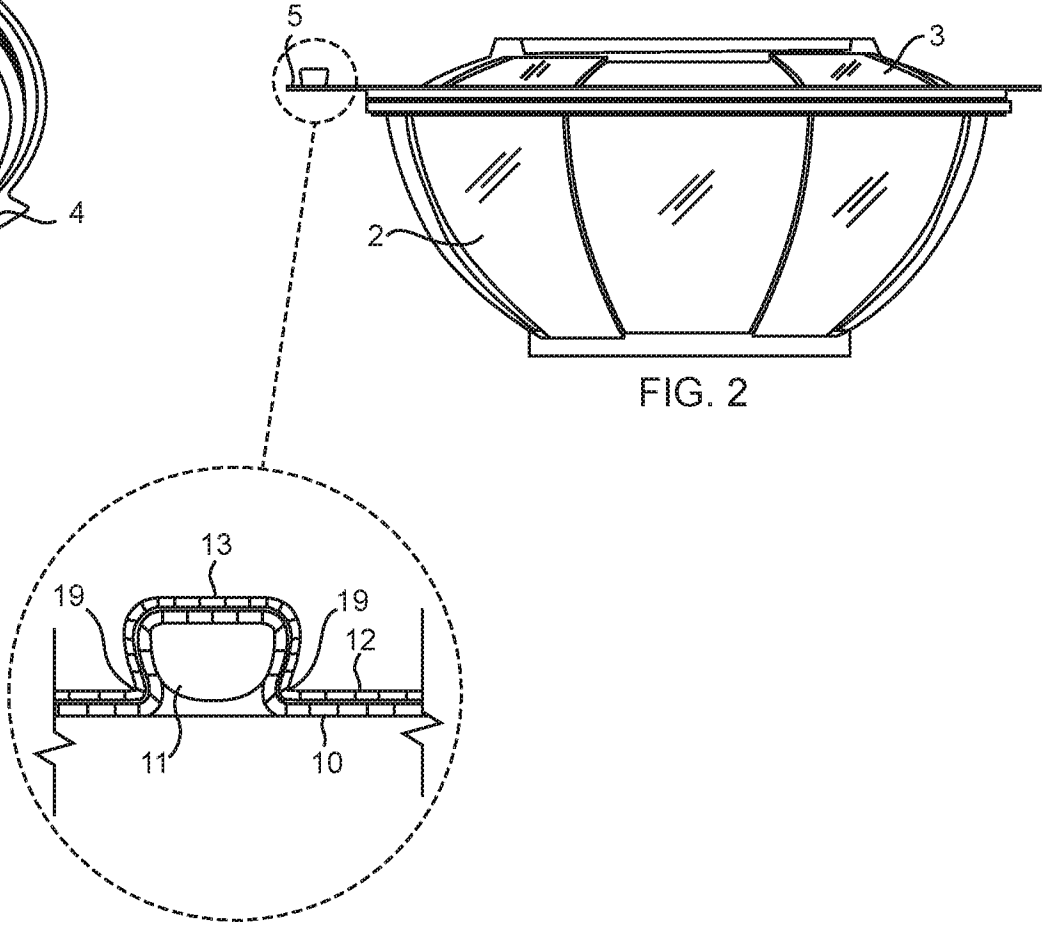
FIG. 2 is a right-side elevational view of the container shown in FIG. 1 with the cover positioned over the base in a closed state and illustrating an exploded view of the tamper evident locking members.

Referring to FIG. 2, opposing indentations 19 are illustratively formed in opposing sidewalls forming the female locking member 13. The male locking member 10 has a width that is less than the width between the opposing interior sidewalls of the female locking member 13, but greater than the width of the gap formed between the opposing indentations 19, as illustratively shown by the exploded view of the tamper-evident locking assembly 5 in FIG. 2. When closing the tamper-evident locking assembly 5, the indentations 19 and/or the projection 11 will temporarily deflect or deform a sufficient distance to permit passage of the male locking member 11 into its female counterpart 13. In one aspect, the projection 11 has a bulbous-like or flattened-bulbous shape to increase the surface areas as between the male and female locking members. The bulbous shaped projection 11 and corresponding indentations 19 formed in the recess 13 together enhance the snap-fit relation as between the male and female locking members.

The second member 12 is, thus, formed as a pull-off member that is torn off when the cover 3 of the container 1 is initially opened to gain access to the contents after the container has been initially closed and locked. Thus, any disengagement of the second member 12 from the first member 10 and/or from the circumferential flange 8 of the cover 3 is an indication of an authorized or unauthorized opening of the container.

The foregoing description represents one of many possible embodiments of a tamper-evident interface formed by snap-fit lock according to the present invention.

In an alternative embodiment, the first member 10 is fixedly secured to the cover 3, whereas the second member 12 is secured to the base 2 along a weakened separation line 14. Further, the first member 10 can be provided with a recess, while the second member includes the complementary male projecting element. In another aspect, both members 10, 12 can be formed with interlocking tabs which are secured to the respective flanges along respective weakening lines 14.

As will also be apparent to those familiar with the art, while the container 1 shown in the drawings is formed as a bowl, a container of any shape (e.g., a rectilinear tray, box, and the like) can be provided with a tamper-evident locking assembly 5 according to the present invention.

Although the present invention has been shown and described with reference to a preferred embodiment, such is merely illustrative of the present invention and is not to be construed as limiting and various modifications of the present invention will be apparent to those skilled in the art. The scope of the present invention is therefore to be determined by the claims.

The invention claimed is:

1. Tamper-evident locking members for releasably securing a thermoformed cover and base together to form a container, each of the locking members extending, respectively, from a periphery of the base and cover, and dimensioned and configured to engage in superposed relation when the cover is secured to the base, the locking members comprising:

a. a male locking member having a first surface with at least one integrally molded male element projecting outwardly; and b. a female locking member having a second surface with at least one integrally molded enclosed recess projecting inwardly, the at least one recess being configured and dimensioned to receive and engage the at least one male element in a secure manually releasable snap-fit relation when the cover and base are in sealed relation, wherein the male locking member or the female locking member includes at least one integrally formed pull-tab extending laterally from the at least one of the respective male and female locking members, at least one of the male and female locking members and corresponding pull-tabs being joined directly to the periphery of the container along a line of manually separable perforations, and wherein the locking members are disengaged and separated from each other by manually tearing and contemporaneously removing the at least one pull-tab with the corresponding integrally formed locking member from the container along the line of perforations.

2. The tamper-evident locking members of claim 1 in which the male and female locking members are spaced apart from the periphery of the container to provide a laterally projecting gripping tab dimensioned and configured to assist in manually separating the cover and the base.

3. The tamper-evident locking members of claim 2, wherein the gripping tab is thermoformed with one or more proj ecting elements and corresponding recesses to facilitate secure manual gripping.

4. The tamper-evident locking members of claim 1, wherein the at least one projecting male element is generally rectilinear and is configured to securely engage the at least one recess in the female locking member in a snap-fit relation.

5. The tamper-evident locking members of claim 1, wherein the at least one projecting male element comprises two generally cylindrical projecting male elements.

6. The tamper-evident locking members of claim 1, wherein the male and female locking members are integrally thermoformed with the container from at least one of polystyrene, polypropylene, and polyethylene terephthalate.

7. The tamper-evident locking members of claim 1, wherein the removed at least one pull-tab with the corresponding integrally formed locking member is permanently severed from the container in an opened or tampered state of the container.

8. The tamper-evident locking members of claim 1 further comprising a hinge connecting the base and cover for relative movement to open and close the container.

9. A thermoformed polymer container, comprising:

a base formed by one or more sidewalls defining a chamber;

a cover dimensioned and configured to securely engage the base for closing the chamber;

a tamper-evident interface having a first member forming part of the base and extending outwardly from a periphery of the base, and a second member forming part of the cover and extending outwardly from a periphery of the cover, the first and second members being configured to securely engage with each other in an initial closed position of the container;

wherein at least one of the first and second members is releasably connected directly to a corresponding one of the periphery of the base and the cover by a single weakened parting line, and is permanently separated therefrom upon an initial opening of the container after an initial closing of the container by contemporaneously severing one of the first and second members from the container and each other along the single weakened parting line.

10. The thermoformed polymer container of claim 9, wherein one of the first and second members is formed as a tab having a projection, and another of the first and second members is likewise formed as a tab having a recess for receiving the projection formed on the first member in an interlocking relationship when the container is initially closed, wherein the first and second members form a lock for fixedly securing the cover to the base in the initial closed position of the container.

11. The thermoformed polymer container of claim 9, wherein the base has an outwardly extending circumferential flange and a shoulder provided beneath the circumferential flange along an entire circumference of the base, and forming an undercut;

wherein the cover likewise has an outwardly extending circumferential flange similar to the circumferential flange of the base, and a ridge provided beneath the circumferential flange and extending along an entire circumference of the cover for engaging and forming a seal with the undercut formed in the base in a closed position of the container and;

wherein the first and second members are extending from edges of respective flanges.

12. The thermoformed polymer container of claim 11, wherein the first member is integrally formed directly with and extends outwardly from the circumferential flange of the base, and the second member is integrally formed directly with and extends outwardly from the circumferential flange of the cover at the location opposite the first member when the cover is in position over the base.

13. The thermoformed polymer container of claim 9 further comprising a hinge connecting the base and cover for relative movement to open and close the container.

14. The thermoformed polymer container of claim 13, wherein the lock is positioned opposite the hinge.

15. A reclosable plastic container, comprising a base defining a storage space and having, at an upper end thereof, an outwardly extending circumferential flange;

a cover for enclosing the base and having an outwardly extending circumferential flange corresponding to the circumferential flange of the base portion;

a tamper-evident lock having a first member integrally formed with and extending outwardly from the circumferential flange of the base, and a second member integrally formed with and extending outwardly from the circumferential flange of the cover at a location opposite the first member when the cover is in position over the base, the second member being releasably secured to the first member when the container is locked by the tamper-evident lock; and wherein one of the first and second members is formed as a detachable pull-off section releasably joined along a single weakened parting line which is positioned between the detachable pull-off section and a portion of a peripheral edge of the adjacent circumferential flange.

16. The reclosable plastic container of claim 15, wherein the other of the first and second members is formed as a pull-off section releasably joined to the other of the base and cover along a second weakened parting line.

17. The reclosable plastic container of claim 15, wherein the first and second members are formed as projecting tabs provided, respectively, with a projecting male element and a recess for interlocking with the male element in a closed position of the container, the tabs forming a snap-fit lock when engaged.

18. The reclosable plastic container of claim 17, wherein the projection has a transverse cross-section selected from a group consisting of circular, oval, rectangular, square, hexagonal, and the recess has a complementary engaging shape.

19. The reclosable plastic container of claim 17, wherein in the engaged locked position, a frictional force between the male element and the recess is greater than a shearing force required for separating the pull-off sections from the base or cover.

20. The reclosable plastic container of claim 15, wherein the base is formed as a bowl.

21. The reclosable plastic container of claim 15, wherein the base is formed as a tray.

22. The reclosable plastic container of claim 15, wherein at least one of the base and cover includes a sidewall from which the respective circumferential flange extends outwardly.

23. The reclosable plastic container of claim 15 further comprising a hinge connecting the base and cover for relative movement to open and close the container.

24. The reclosable plastic container of claim 15, wherein the one of the first and second members is formed as a permanently detachable pull-off section.

25. The reclosable plastic container of claim 15, wherein the first and second members are disengaged and separated from each other by manually tearing and contemporaneously removing the detachable pull-off section from the container along the single weakened parting line.

26. The reclosable plastic container of claim 23, wherein the lock is located opposite the hinge.

27. A thermoformed polymer container, comprising:

a first shell having a peripheral edge;

a second shell having a peripheral edge and dimensioned and configured to securely engage with the peripheral edge of the first shell to define an interior chamber;

a tamper-evident interface having a first member forming part of the first shell and extending outwardly from the peripheral edge of the first shell, and a second member forming part of the second shell and extending outwardly from the peripheral edge of the second shell, the first and second members being dimensioned and configured to securely engage with each other in an initial closed position of the container; and wherein at least one of the first and second members is releasably connected directly to a corresponding one of the peripheral edges of the first and second shells by a single weakened parting line, and is physically separable therefrom upon an initial opening of the container in a locked state by contemporaneously severing the one of the first or second members from the container and each other along the single weakened parting line.

28. The thermoformed polymer container of claim 27 further comprising a hinge connecting the first shell and second shell for relative movement to open and close the container.

29. The thermoformed polymer container of claim 27, wherein the first member is formed directly with and extends outwardly from the peripheral edge of the first shell, and the second member is formed directly with and extends outwardly from the peripheral edge of the second shell.

* * * * *